US005945632A

United States Patent [19]

Butera

[11] Patent Number: 5,945,632

[45] Date of Patent: Aug. 31, 1999

[54] RIBBON OVERBRAID CABLE

[75] Inventor: Louis L. Butera, Staten Island, N.Y.

[73] Assignee: DiMarzio Inc., Staten Island, N.Y.

[21] Appl. No.: 08/911,758

[22] Filed: Aug. 15, 1997

[51] Int. Cl.[6] ..... H01B 11/18

[52] U.S. Cl. ..... 174/36; 174/112

[58] Field of Search ..... 174/36, 103, 106 R, 174/107, 112

[56] References Cited

U.S. PATENT DOCUMENTS

| | | | |
|---|---|---|---|
| 1,890,291 | 12/1932 | Hinsky | 449/3 |
| 2,120,306 | 6/1938 | Zender | 174/112 |
| 3,661,686 | 5/1972 | Armstrong | 428/164 |
| 3,819,973 | 6/1974 | Hosford | 313/498 |
| 4,408,089 | 10/1983 | Nixon | 174/36 X |
| 4,733,464 | 3/1988 | Gregorac | 29/867 |
| 4,965,412 | 10/1990 | Lai et al. | 174/107 |
| 4,994,317 | 2/1991 | Dugan et al. | 428/246 |
| 5,254,188 | 10/1993 | Blew | 174/36 X |
| 5,414,211 | 5/1995 | Chan | 174/36 |

*Primary Examiner*—Kristine Kincaid
*Assistant Examiner*—Chau N. Nguyen
*Attorney, Agent, or Firm*—Baker & Botts, L.L.P.

[57] ABSTRACT

A ribbon overbraid cable includes a core such as a coaxial cable; a ribbon overbraid including braided, reflective ribbon, the overbraid enmeshed about and surrounding the core; and an extruded layer of transparent or translucent polymer extruded over the overbraid, whereby the overbraid is highly reflective of light incident on the cable and whereby the cable is protected against fraying.

6 Claims, 2 Drawing Sheets

RIBBON OVERBRAID CABLE

SPECIFICATION

This invention relates to cables and, more particularly, to a ribbon overbraid cable having an outer ribbon overbraid and a thin layer of clear polymer to provide a fray-resistant cable with a highly reflective and decorative appearance.

BACKGROUND OF INVENTION

In the shielded cable art, it is known to provide shielding in the form of a metallic overbraid wrapped around an insulated central conductor; see e.g., U.S. Pat. No. 5,414,211. The shielding function requires that the overbraid provide an unbroken conductive layer. Consequently, it is necessary that the overbraid strands be in conductive contact with each other.

Typically, the shielding overbraid is covered with a plastic layer or a textile layer to provide protection and abrasion resistance for the cable. Thus, the color and appearance of the cable is dictated by the appearance of the plastic layer.

In many applications, the appearance or color of a cable is of no consequence since the cable is generally not in open view and cable aesthetics is of little concern. However, in the case of performances by modern musical groups which use electronic equipment extensively, the cables interconnecting the musical instruments to the other electronic gear are in full view of the audience. Therefore, the cable's appearance, along with the instrument and other equipment, under imaginative lighting, becomes an important element of the overall presentation.

In the electrical conductor art, overbraiding of wires with textile materials, such as nylon or cotton yarn, has been used for some time to provide a pleasing appearance and protection against abrasion. For example, these materials have been used since the 1940s with electrical appliances, such as toasters and irons. While overbraids composed of these materials provide cables with some protection from damage, they tend to fray after extended usage. Also, cables with overbraids composed of these materials have little or no reflective characteristics due to their matte-like surfaces and, thus, would be virtually invisible to the eyes of an audience when the cable is used on-stage.

An object of the present invention is to provide an overbraid cable made of ribbon, rather than bundles of yarn, which has a decorative and reflective appearance. A further object of the present invention is to provide a ribbon overbraid cable which resists fraying.

SUMMARY OF THE INVENTION

The present invention provides a decorative ribbon overbraid for shielded cable or the like, the ribbon overbraid comprising braided, reflective ribbon surrounding the cable, and an extruded layer of transparent or translucent polymer extruded over the overbraid, whereby the overbraid is highly reflective of light incident on the cable and whereby the cable is protected against fraying.

Preferably, the ribbon is comprised of a metallic material which has a glossy surface, such as aluminum, laminated between two layers of transparent or translucent polymer. This lamination reduces the effect of oxidation of the metallic layer and increases the pull strength of the ribbon when fed through the braiding machine.

The highly reflective ribbon coated with a transparent or shaded translucent polymer layer can provide strong, fray-resistant cables with many different appearances new to the cable industry. In this regard, the ribbon can be preferably comprised of a holographic, metalflake or phosphorescent material.

BRIEF DESCRIPTION OF THE DRAWING

Further objects, features and advantages of the invention will become apparent from the following detailed description taken in conjunction with the accompanying figures in which.

Figure 1:
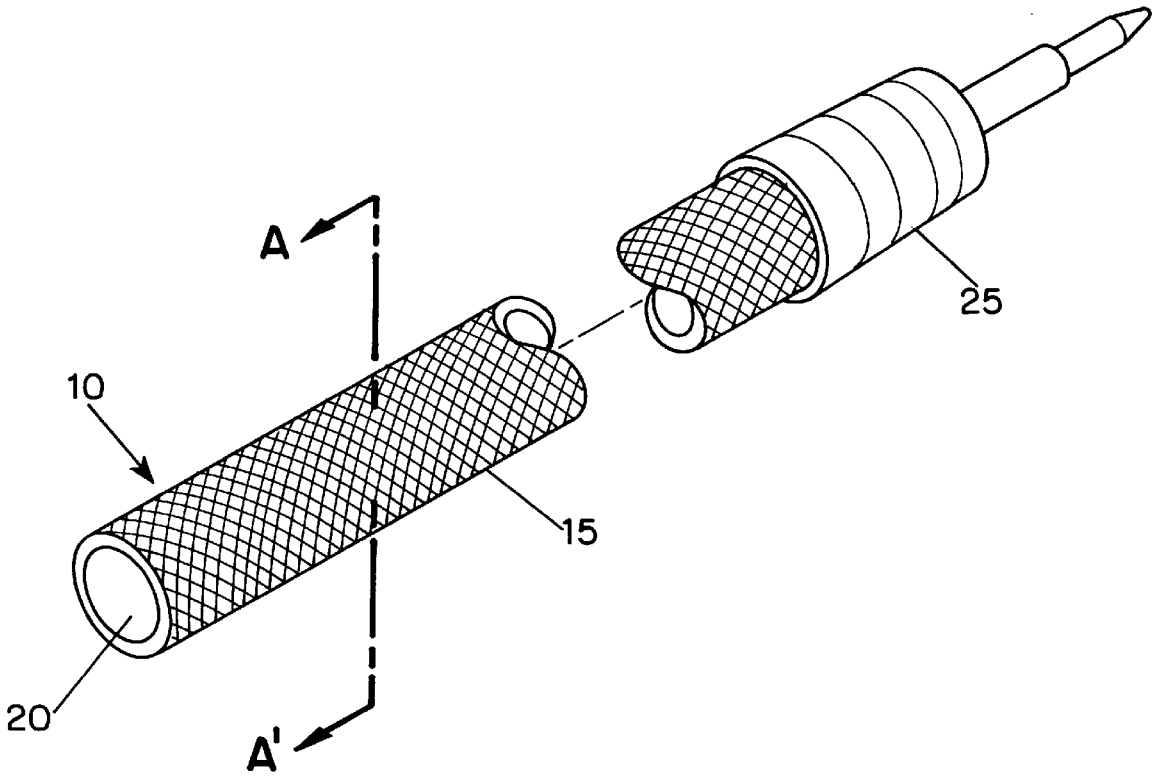
FIG. 1 is a perspective view of a preferred embodiment of the ribbon overbraid cable in accordance with a preferred embodiment of the invention.

Throughout the figures, the same reference numerals and characters, unless otherwise stated, are used to denote like features, elements, components or portions of the illustrated embodiment. Moreover, while the subject invention will now be described in detail with reference to the figures, it is done so in connection with preferred embodiments. It is intended that changes and modifications can be made to the described embodiments without departing from the true scope and spirit of the subject invention as defined by the appended claims.

DETAILED DESCRIPTION

FIG. 1 illustrates a perspective view of a preferred embodiment of the ribbon overbraid cable 10 of the present invention. Overbraid 15 consists of a highly reflective (glossy) ribbon material braided or woven to surround the core 20 of cable 10. The ribbon overbraid 15 is made of a metallic material such as aluminum to maximize its reflective characteristics. While the cable 10 shown in FIG. 1 includes a plug 25 for insertion into a mating jack of an electrical apparatus, such as a guitar or amplifier (not shown), it is understood that the core 20 of cable 10 can be any shielded or unshielded cable such as that used for a microphone, a computer or an electronic toy. Furthermore, one skilled in the art will appreciate that the decorative overbraid of the present invention can be applied to cores other than electrical conductors.

Figure 2:
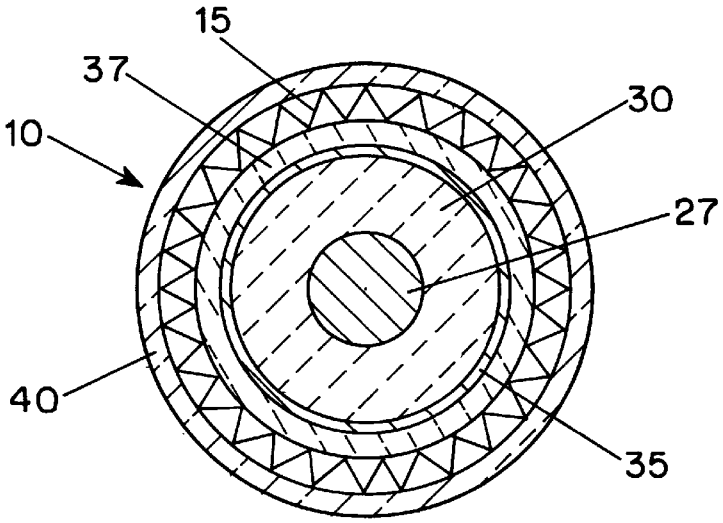
FIG. 2 is a cross-sectional view of the ribbon overbraid cable of FIG. 1 taken along A–A'.

FIG. 2 shows a cross-sectional view of the ribbon overbraid cable 10 of FIG. 1 taken along A–A'. Although it is shown as consisting of a single wire, the central conductor 27 can consist of two or more wires extending longitudinally along the length of the cable 10. A layer of insulating material 30 is disposed around the central conductor 27. In the case of a coaxial cable, a shield 35 is disposed between the central conductor 27 and the overbraid 15, the shield 35 surrounded by a non-conductive layer 37. Thus, in the embodiment of FIG. 2, the core 20 consists of conductor 27, insulating material 30, shield 35 and non-conductive layer 37.

In accordance with the present invention, after the overbraid 15 is wrapped onto the core 20, a layer of polymer 40 is extruded over the outside portion of the overbraid 15. The plastic layer 40 preferably is transparent, but it may have a translucent, i.e. color-shaded, appearance. The plastic layer provides protection against fraying and permits the overbraid material 15 to reflect light which is incident on the cable 10, for example, during a stage production. The layer 40 is preferably 0.15 to 0.20 inches in thickness to maximize protection against fraying without affecting the reflective characteristics of the cable.

Figure 3:
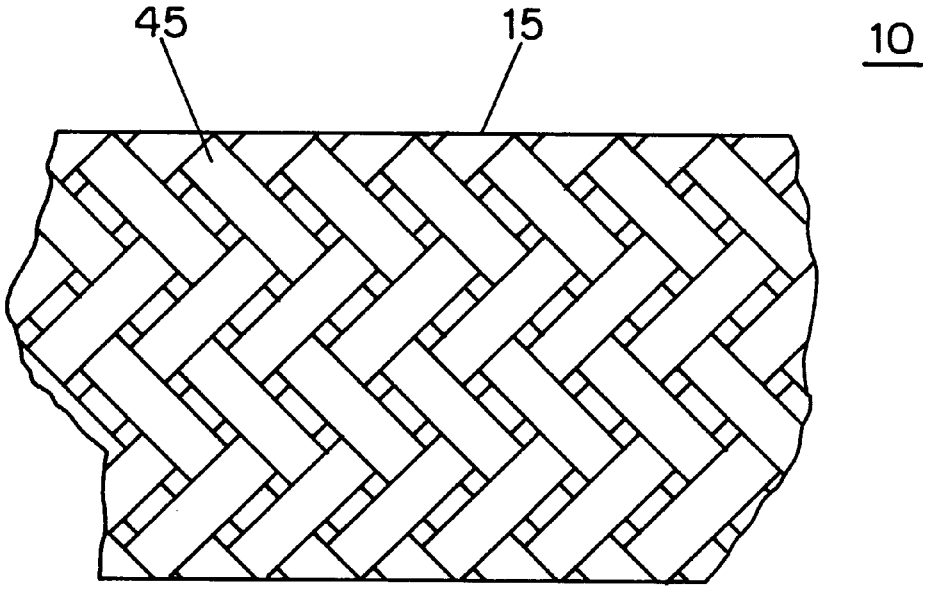
FIG. 3 is a close-up surface view of the ribbon overbraid cable of FIG. 1.

FIG. 3 is a closeup view of the overbraid 15 of the cable 10 of the present invention. The overbraid 15 consists of ribbon 45 of highly reflective material, such as plastic-laminated aluminum. The glossy interwoven ribbon 45 provides a decorative appearance when light is incident on the cable 10. The ribbon 45 is woven so that decorative patterns appear on the overbraid 15.

Due to the transparency or translucence of the polymer 40, ribbon 45 can be composed of material capable of providing completely new looks to the cable industry. For instance, a material which is holographic can be used. This material provides a three-dimensional image which can be multicolored. The image appears to change as the angle of viewing or the direction of light incident the cable varies. Ribbon 45 can also utilize a metalflake material having flakes of color which provide a speckled appearance when light is directed on it. Ribbon 45 can also be made of a phosphorescent material which absorbs incident light and re-radiates for a noticeable period of time after the incident ceases. Thus, the familiar "glow-in-the-dark" appearance results.

Figure 4:
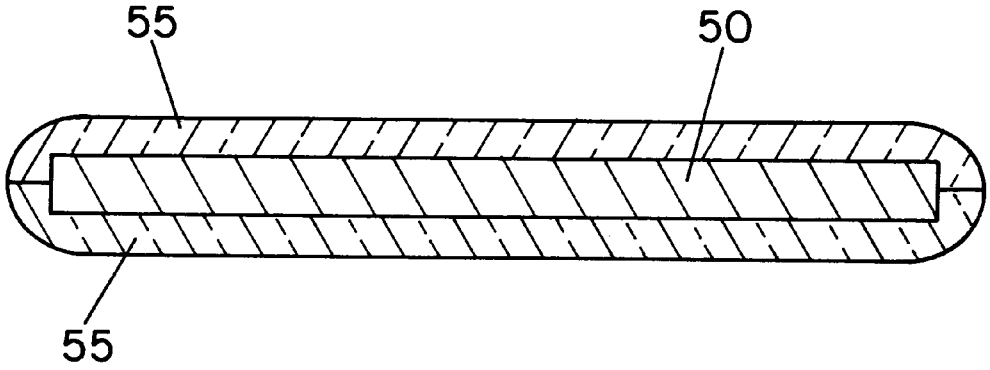
FIG. 4 is a cross-sectional view of the ribbon of a preferred embodiment of the ribbon overbraid cable of FIGS. 1–3.

The ribbon 45 is comprised of a metallic layer 50, such as aluminum, laminated on both surfaces and completely encased between two polymer layers 55, as shown in FIG. 4. The polymer layers 55 are preferably transparent, but can be translucent with a shaded color. The lamination provides protection against oxidation of the metallic material 50 before the ribbon 45 is woven onto cable 10 and covered by the layer of polymer extrudate 40. The polymer layers 55 also provide for greater tensile strength of the ribbon 45 when fed through a braiding machine, thereby preventing breaks.

Other modifications of the invention will occur to those skilled in the art such as including different ribbon materials or different polymer types and shades, and it is intended that the scope of the invention be limited only as set forth in the appended claims.

I claim:

1. A ribbon overbraid cable comprising:

a core;

a ribbon overbraid comprising braided, reflective ribbon, the overbraid enmeshed about and surrounding the core, said reflective ribbon comprising a metallic material; and a layer of transparent or translucent polymer disposed directly over the overbraid, whereby the overbraid is highly reflective of light incident on the cable and whereby the cable is protected against fraying.

2. The ribbon overbraid cable of claim 1, wherein the metallic material is aluminum.

3. The ribbon overbraid cable of claim 1 wherein the ribbon is comprised of a metallic layer disposed between two laminating layers of transparent or translucent polymer.

4. The ribbon overbraid cable of claim 1 wherein the ribbon is comprised of a metalflake material.

5. The ribbon overbraid cable of claim 1 wherein the core is a coaxial cable having a central conductor surrounded by an insulating layer, and a concentric shielding layer surrounded by a non-conductive outer layer, said ribbon overbraid surrounding said non-conductive layer.

6. A ribbon overbraid cable comprising:

a core;

a ribbon overbraid comprising braided, reflective ribbon, the overbraid enmeshed about and surrounding the core, said reflective ribbon comprising a holographic material; and a layer of transparent or translucent polymer disposed over the overbraid, whereby the overbraid is highly reflective of light incident on the cable and whereby the cable is protected against fraying.

* * * * *